US005154630A

United States Patent [19]

Kamono et al.

[11] Patent Number: 5,154,630

[45] Date of Patent: Oct. 13, 1992

[54] PLUG CONNECTOR ASSEMBLY

[75] Inventors: Takashi Kamono, Yokohama; Kunio Nakamura, Tokyo; Izumi Hasegawa, Yokohama, all of Japan

[73] Assignee: AMP Incorporated, Harrisburg, Pa.

[21] Appl. No.: 811,753

[22] Filed: Dec. 20, 1991

[30] Foreign Application Priority Data

Dec. 28, 1990 [JP] Japan ..... 2-408999

[51] Int. Cl.[5] ..... H01R 13/627

[52] U.S. Cl. ..... 439/352; 439/355; 439/540; 439/701; 439/752

[58] Field of Search ..... 439/352, 355, 367, 529, 439/533, 701, 368, 351, 357, 358, 594, 599, 752

[56] References Cited

U.S. PATENT DOCUMENTS 4,674,814 6/1987 Hoshino et al. ..... 439/701 X
4,708,662 11/1987 Klein ..... 439/357 X
4,884,978 12/1989 Inaba et al. ..... 439/352
4,984,998 1/1991 Duncan et al. ..... 439/752 X
4,997,386 3/1991 Kawachi et al. ..... 439/355 X
5,037,336 8/1991 Betsui ..... 439/752

FOREIGN PATENT DOCUMENTS 2-22943 4/1990 Japan .

*Primary Examiner*—Larry I. Schwartz
*Assistant Examiner*—J. Daulton
*Attorney, Agent, or Firm*—Adrian J. Larve

[57] ABSTRACT

A plug connector assembly (1) includes a housing (2) adapted to receive multiple connectors (9) inserted therein carrying cables (8) with a cover (3) having mating halves (3*a*, 3*b*) which latch together onto the housing, locking the connectors in place. The housing includes a resilient arm (4) operable to latch the assembly to a mating connector. The cover (3) includes a further resilient arm (3*b*) operable to depress the housing resilient arm to disengage the assembly from the mated connector.

5 Claims, 4 Drawing Sheets

1
2
3
3b
3i
3h
4
4a
6
8

PLUG CONNECTOR ASSEMBLY

This invention relates to a plug connector assembly of mutually latching parts, including housing, connectors, and cover.

BACKGROUND OF THE INVENTION

It is standard practice to utilize plug and receptacle connectors having intermating contacts terminated to wires to electrically interconnect circuits for a wide variety of applications, including appliance, automotive, and computer applications. Typically, the connector housings are of a resilient and flexible plastic material and incorporate latches, typically formed on mutually engaging surfaces of the connector halves with one of the halves including a resilient arm carrying such surface. Japanese publication Number 22943/1990 shows such a connector incorporating an integral resilient arm in the plug half of a connector.

The present invention has as an object the provision of an improved connector assembly featuring a latching mechanism for multiple connectors incorporated into such assembly. The invention has as a further object the provision of a connector assembly of housing, multiple connectors and cover which internest and lock together without external hardware to provide a reliable interconnection in the face of tensional and vibrational forces.

Still a further object is to provide a simple and easily assembled multi-way connector having improved latching features.

SUMMARY OF THE INVENTION

The present invention achieves the foregoing objects through the provision of an assembly of molded plastic parts, including a housing and connectors that fit in a recess therein, and a cover which fits over the housing and over the connectors and latches together with such elements to form an integral unit. The housing recess is adapted to receive multiple connectors inserted therein, the connectors carrying receptacle contacts terminated to cables and including external latches which cooperate with internal projections of the housing to latch the forward end of the connectors within the housing. The connectors include projecting rear portions which receive the cables terminated by the connectors and provide a strain relief therefor. The connectors also include proximate the rear thereof, recesses adapted to be engaged by projections of the halves of a cover which snaps down over the connectors to lock the connectors against axial withdrawal and to provide an additional strain relief. The cover halves latch together around grooves in the housing toward the rear thereof and include forwardly projecting portions which internest with complementary portions of the housing to resist withdrawal in an axial sense of the cover relative to the housing. The housing includes, projecting rearwardly, cantilever spring arms which form latches engaging the interior projections of a mating connector upon insertion of the invention assembly therein. The latches of the housing are carried by resilient arms which are deflected transversely to the axis of insertion upon insertion to restore outwardly and effect the latching of the connector and assembly of the invention to the mating receptacle connector half. The cover of the invention also includes a resilient arm projecting forwardly and overlying a projection from the resilient arms of the housing such that when the plug half connector assembly is mated with the receptacle half, a deflection of the cover arm from the rear of the cover will engage the projection of the resilient arms of the housing and deflect them radially inwardly, in a sense, transverse to the axis of engagement and allow a disengagement of the connector assembly from the mating connector half. The invention assembly is arranged so that the preterminated connectors may be inserted within a housing and latched therein toward the front end thereof with the cover then being applied through the halves thereof being snapped together to lock the connectors toward the rear thereof to the cover. The sides of the cover include latches to latch the cover to the housing as well.

BRIEF DESCRIPTION OF THE DRAWINGS

FIG. 3 is a side view, in elevation, of the connector shown in FIG. 2.

DETAILED DESCRIPTION OF THE INVENTION

Figure 1:
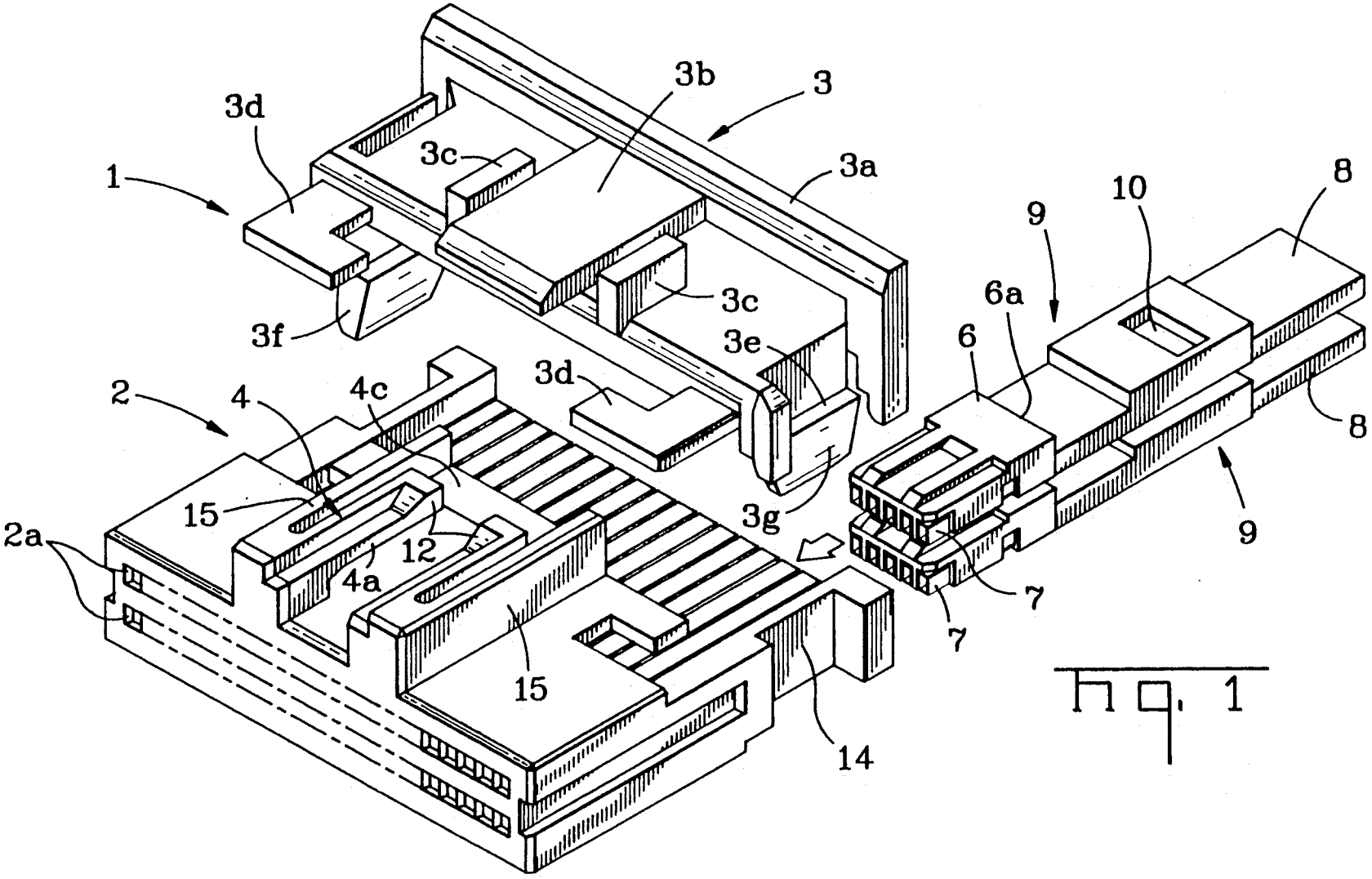
FIG. 1 is a perspective exploded view of the invention showing a housing, the upper part of a cover, and connectors preparatory to assembly.
Figures 2, 4, 5, 7:
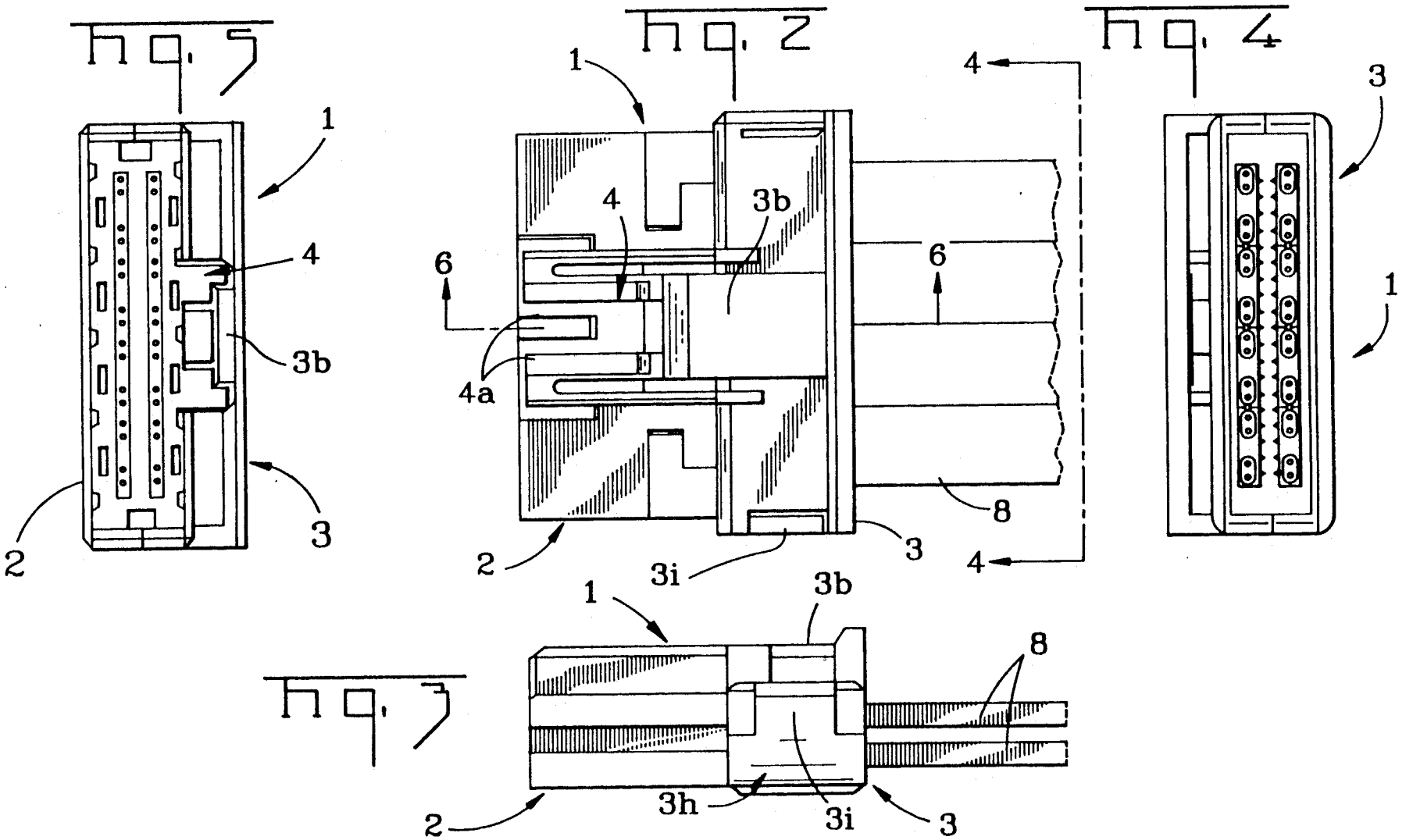
FIG. 2 is a top plan view of the connector assembly as assembled.
FIG. 4 is an elevational view taken along lines 4—4 of the view shown in FIG. 2.
FIG. 5 is a front view of FIG. 2.
FIGS. 7 and 8 are part cross-sectional views of alternative embodiments.

Referring now to FIG. 1, the invention assembly 1 is shown to include a housing 2, a cover 3, and connectors 9 terminated to cables 8 preparatory to assembly. The bottom half of the cover 3 is not shown in FIG. 1 but is shown in FIGS. 3–5 with the cover assembled. The cover upper half 3*a* includes a resilient arm 3*b* extending forward above the main body of the cover half and between projections 3*c* which protect the arm 3*b* from damage in use or handling. The cover half 3*a* further includes flat L-shaped projections 3*d* extending forwardly for purposes to be described and latching projections 3*f* and 3*g* extend downwardly. The bottom half 3*h* of the cover, shown in FIG. 3, includes side members 3*i* which include oppositely oriented latches, similar to the latches 3*f* and 3*g*, which cooperate with surfaces 3*e* of the latches 3*f*, 3*g* of the cover half 3*a* to latch the two halves together in a vertical or radial sense relative to the insertion axis of the connector, shown as A in FIG. 6. FIG. 3 shows the upper half 3*a* of cover 3 to include a bridge structure supporting the resilient arm 3*b* for radial deflection downwardly. Depression of the arm 3*b* is achieved by an operator attempting to separate the connector assembly 1 from a mating connector half, a receptacle half, adapted to receive the plug half assembly 1.

Figure 6:
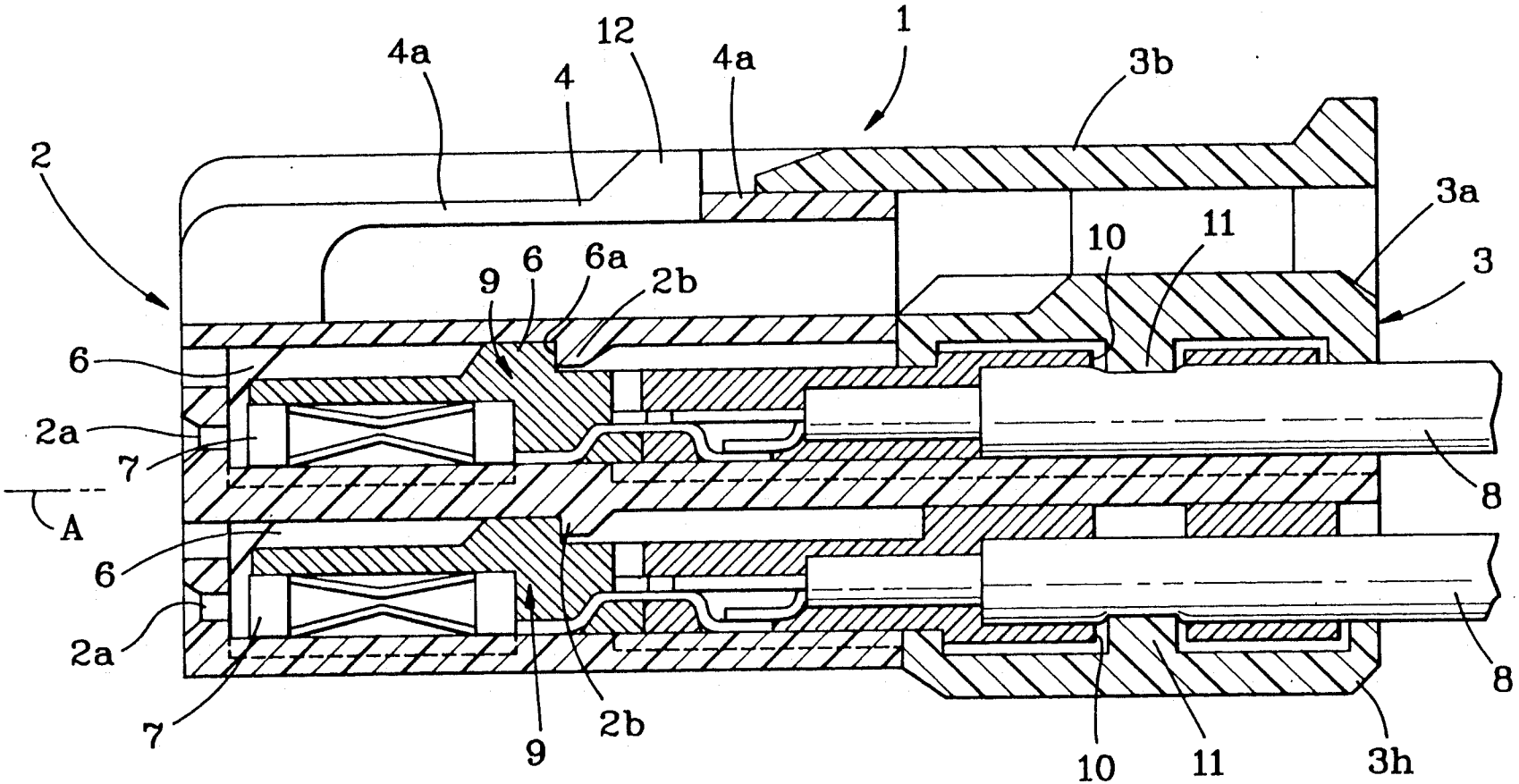
FIG. 6 is a cross-sectional view taken along lines 6—6 of the connector shown in FIG. 2.
Figure 7:
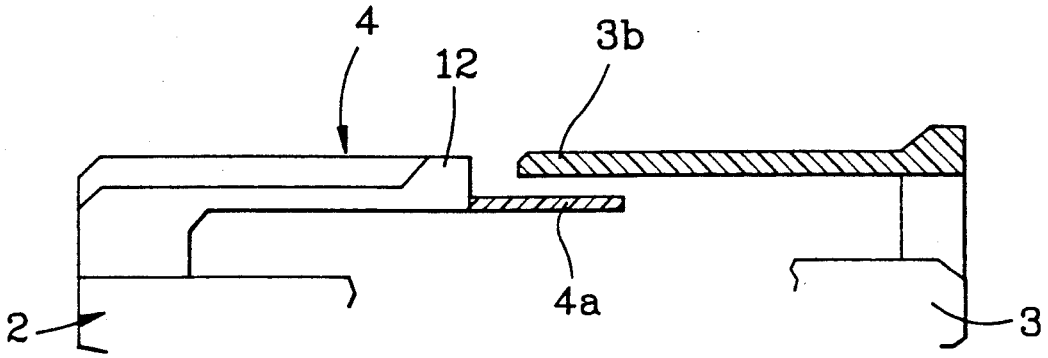

FIG. 6 shows connector housing 2 including internal recesses 6 extending within the body of the housing, the recesses arranged in two rows extending across the width of the housing and each including an interior projection 2*b* adapted to latch connectors 9 inserted in such recesses along the axis A of insertion of the connector with a mating connector half. As shown in FIG. 1, the housing 2 further includes a latch member 4 including a projection 4*a* extending at the ends of resilient arms 4*b*. Both reside above the main body of the housing and both are adapted to be deflected downwardly in a sense transverse to the insertion axis A during engagement with the mating receptacle connector (not shown), referring to FIG. 5. The projections 12 of resilient arms 4*b* cooperatively engage a latching projection of the matable receptacle connector. A downward deflection, as by an operator squeezing the cover, driving arm 3*b* transverse to the axis A will also deflect the latch member 4 through the engagement of projection 4*a* with the end of arm 3*b*. Both of the arm 3*b* and latch member 4 will restore to the normal position shown in FIG. 5 following deflection. The latch member 4 thus is driven inwardly by arm 3*b* during disengagement of connector 1 from it matable connector.

FIGS. 1 and 2 show the housing 2 to include a pair of projections 4*c* which reside in the plane of the upper surface of the housing and are L-shaped to receive the projections 3*d* of the cover when the cover halves are snapped together. The engagement of these projections cover over the connectors 9 as inserted within the housing recesses but extending back along the housing and additionally, through internesting, resist withdrawal of the covers in an axial sense during unmating of the plug and receptacle connectors or due to strains applied to the cables 8 of connectors 9. Further projections 15, as shown in FIG. 1, protect the resilient arms 4*a* during handling and use against damage.

As can be seen in FIGS. 1 and 6, a series of apertures 2*a* are incorporated in rows in the front face of housing 2 to facilitate entry of contact pins extended into the housing to engage receptacle contacts 7 in the connectors 9. FIG. 4 shows, in section, cables including conductors, which are terminated by the contacts 7 within the connectors 9 and in turn interconnect to the pins (not shown) which extend within apertures 2*a* into the contacts 7. The housing 2 includes further slots 14 along the side wall which receive latches 3*f*, 3*g* of cover half 3*a* to secure it thereon.

The connectors 9 include forward housing portions 6 which have surfaces 6*a* engaged by the projections 2*b* in the manner shown in FIG. 6 and they further include toward the rear of the housing recesses 10 which are engaged by projections 11 on the cover halves 3*a* and 3*h* and which resist axial stresses on the connector assembly due to disengagement of the plug half assembly or strains applied to the cables 8.

In practice, the housing 2 is molded of engineering plastic sufficient to define the required characteristics of the resilient arms 4*a*. The covers are molded in two halves and the connectors are molded of plastic and terminated in a suitable fashion to the wires of cables 8. The connectors, as terminated, are inserted into the housing into the position shown in FIG. 6 with the cover halves applied down over the connectors until the latches thereof snap into place thus resulting in a plurality of latches locking several parts of the assembly together.

Figure 8:
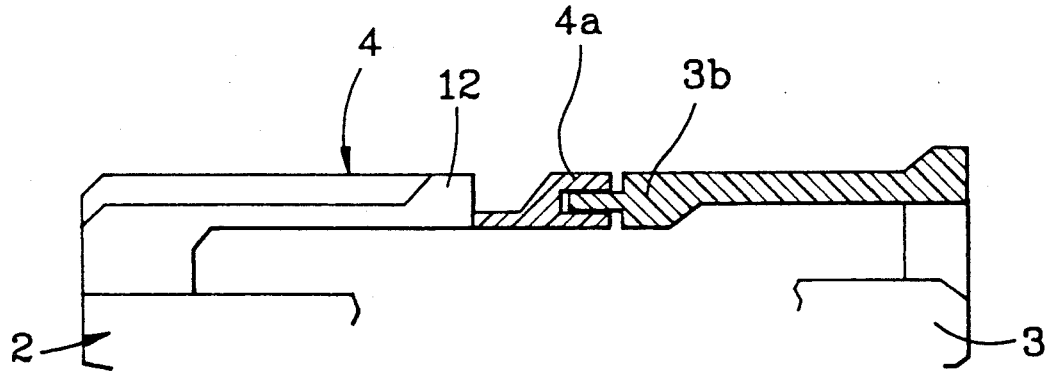

In the alternative embodiment, as shown in FIG. 7, the free end of arm 3*b* is spaced from projection 4*a*; whereas, in FIG. 8, the free end of arm 3*b* has a projection that is disposed in a recess in projection 4*a*.

Having now described the invention in relation to the drawings, claims are appended intended to define the invention.

What is claimed is:

1. A connector assembly including a housing, a plurality of connectors and a cover, the housing having a recess to receive the connectors inserted therein and including a housing resilient arm adapted to latch the assembly and said connectors to a mating connector engaged along a given axis, the cover having halves including latches engaging surfaces of said housing in a sense transverse to said given axis and including further portions overlying and internesting with portions of said housing to preclude axial withdrawal of said cover from said housing, said cover having a cover resilient arm positioned to overlie portions of said housing resilient arm and operable to press said housing resilient arm inwardly transverse to said given axis to disengage said assembly from the mating connector.

2. The connector of claim 1 wherein said housing and cover include interior projections positioned to engage surfaces on said connectors to lock said connectors to said housing and to said cover against withdrawal along said given axis.

3. The connector of claim 1 wherein portions of said cover extend in a common plane relative to portions of said housing and internest to lock said cover to said housing against withdrawal along said given axis.

4. The assembly of claim 1 wherein the assembly has forward and rearward faces, the cover resilient arm and said housing resilient arm extend from the rear face and forward faces of said assembly, respectively, with said cover arm overlying a projection of the housing arm to facilitate depression of the housing arm for purposes of disengagement of said assembly from a mating connector.

5. In combination, a connector assembly including a housing, connectors and a cover, each of a plastic material having resilience and each including surfaces internesting to fit together with the assembly mating with a mating connector to provide an interconnection, said housing having a recess receiving said connectors inserted along a given axis and a resilient arm operable transverse to said given axis to latch said assembly to a mating connector through a depression radially transverse to said given axis, the cover including halves separately mating with each other having mutually engaging latches cooperatively engaging housing side surfaces and further including projections engaging surfaces formed in said connectors to lock said cover and said connectors to said housing upon closure of said halves together; and said cover including a resilient arm operable to depress said resilient arm of the housing to facilitate withdrawal of said assembly from the mating connector.

* * * * *